US007942282B2

(12) United States Patent
Hung

(10) Patent No.: US 7,942,282 B2
(45) Date of Patent: May 17, 2011

(54) RETAINER FOR SHIPPING CONTAINERS

(75) Inventor: Jen-Yao Hung, Caotun (TW)

(73) Assignee: Universal Global Investment Co., Ltd., Majuro, Marshall Islands (MH)

( * ) Notice: Subject to any disclaimer, the term of this patent is extended or adjusted under 35 U.S.C. 154(b) by 421 days.

(21) Appl. No.: 12/249,155

(22) Filed: Oct. 10, 2008

(65) Prior Publication Data

US 2010/0089914 A1 Apr. 15, 2010

(51) Int. Cl.
*B65D 21/00* (2006.01)
*B65D 85/62* (2006.01)
*B65D 88/00* (2006.01)

(52) U.S. Cl. ..... 220/4.27; 220/1.5; 220/4.26; 206/503; 206/509; 206/511; 206/512; 403/330

(58) Field of Classification Search ..... 220/1.5, 220/4.26, 4.27, 23.2, 23.4, 23.6, 23.83, 694; 206/503, 509, 511, 512; 403/330; 410/69, 410/70, 87, 88
See application file for complete search history.

(56) References Cited

U.S. PATENT DOCUMENTS

| | | | | |
|---|---|---|---|---|
| 3,508,500 | A * | 4/1970 | Gutridge | 410/70 |
| 6,336,765 | B1 * | 1/2002 | Watanabe | 403/325 |
| 6,725,507 | B2 * | 4/2004 | Reynard | 24/287 |
| 7,114,898 | B2 * | 10/2006 | Brewster | 410/70 |
| 7,621,414 | B2 * | 11/2009 | Bederke | 220/1.5 |

* cited by examiner

*Primary Examiner* — Anthony Stashick
*Assistant Examiner* — Madison L Wright
(74) *Attorney, Agent, or Firm* — Jeffrey D. Myers; Peacock Myers, P.C.

(57) ABSTRACT

A retainer for securing together upper and lower shipping containers includes interconnected upper and lower retaining members each adapted to be inserted into a hole in a corner piece of a respective one of the upper and lower shipping containers, and at least one swing member disposed inside the lower retaining member. The upper retaining member has a top end aligned with a bottom end of the lower retaining member along an axial line of the retainer. The swing member includes a lower pivot portion connected pivotally to the lower retaining member, and an upper engaging portion which is proximate to the axial line in a non-engaging position and when the axial line of the retainer is substantially vertical, and which moves away from the axial line in an engaging position when the axial line of the retainer is inclined and non-vertical.

8 Claims, 8 Drawing Sheets

RETAINER FOR SHIPPING CONTAINERS

CROSS-REFERENCE TO RELATED APPLICATIONS

Not Applicable.

STATEMENT REGARDING FEDERALLY SPONSORED RESEARCH OR DEVELOPMENT

Not Applicable.

INCORPORATION BY REFERENCE OF MATERIAL SUBMITTED ON A COMPACT DISC

Not Applicable.

COPYRIGHTED MATERIAL

Not Applicable.

BACKGROUND OF THE INVENTION

1. Field of the Invention

This invention relates to a retainer, more particularly to a retainer for securing together upper and lower shipping containers.

2. Description of the Related Art

Referring to FIGS. 1 and 2, to prevent a stack of shipping containers 12 from shifting away from each other or slipping into the sea from a container ship 11, aside from using a binding device (not shown) to fix the shipping containers 12 to the container ship 11, a plurality of retainers 13 are further used to engage corner pieces 14 of each pair of superimposed shipping containers 12. Each of the retainers 3 has upper and lower retaining members 132, 133, and an intermediate member 131 between the upper and lower retaining members 132,133.

In use, the upper retaining members 132 of the retainers 13 are first inserted into the corner pieces 14 of one shipping container 12, after which a magnetic hanging system 15 is used to move the shipping container 12 to the container ship 11. The lower retaining members 133 of the retainers 13 are then inserted into the corner pieces 14 of another shipping container 12 that is disposed on the container ship 11, thereby securing together the two superimposed shipping containers 12.

Under normal circumstances, the shipping containers 12 maintain their orderly arrangement in a stack for the duration of the journey. However, when the container ship 11 encounters heavy wind and big waves, or bumps into something, the center of gravity of the shipping containers 12 usually follows the body of the container ship 11 and deviates. This results in some of the lower retaining members 133 of the retainers 13 being moved out of the respective corner pieces 14, so that some of the shipping containers 12 may shift away from the stack and may even fall off into the sea.

SUMMARY OF THE INVENTION

Therefore, the object of the present invention is to provide a retainer that is capable of overcoming the aforementioned drawbacks of the prior art.

According to this invention, a retainer for securing together upper and lower shipping containers comprises a hollow lower retaining member, an upper retaining member, and at least one swing member. Each of the upper and lower shipping containers is provided with a corner piece that has a hole. The hollow lower retaining member is adapted to be inserted into the hole in the corner piece of the lower shipping container, and has a bottom end. The upper retaining member is connected to the lower retaining member, is adapted to be inserted into the hole in the corner piece of the upper shipping container, and has a top end aligned with the bottom end along an axial line of the retainer. The swing member is disposed inside the lower retaining member at one side of the axial line, and includes a lower pivot portion connected pivotally to the lower retaining member, and an upper engaging portion extending upwardly from the lower pivot portion. The upper engaging portion is in a non-engaging position when the axial line of the retainer is substantially vertical, and is in an engaging position when the axial line of the retainer is inclined and non-vertical. The upper engaging portion is proximate to the axial line when the upper engaging portion is in the non-engaging position, and moves away from the axial line when the upper engaging portion is in the engaging position.

BRIEF DESCRIPTION OF THE DRAWINGS

Other features and advantages of the present invention will become apparent in the following detailed description of the preferred embodiment of the invention, with reference to the accompanying drawings, in which.

DETAILED DESCRIPTION OF THE PREFERRED EMBODIMENT

Figure 8:
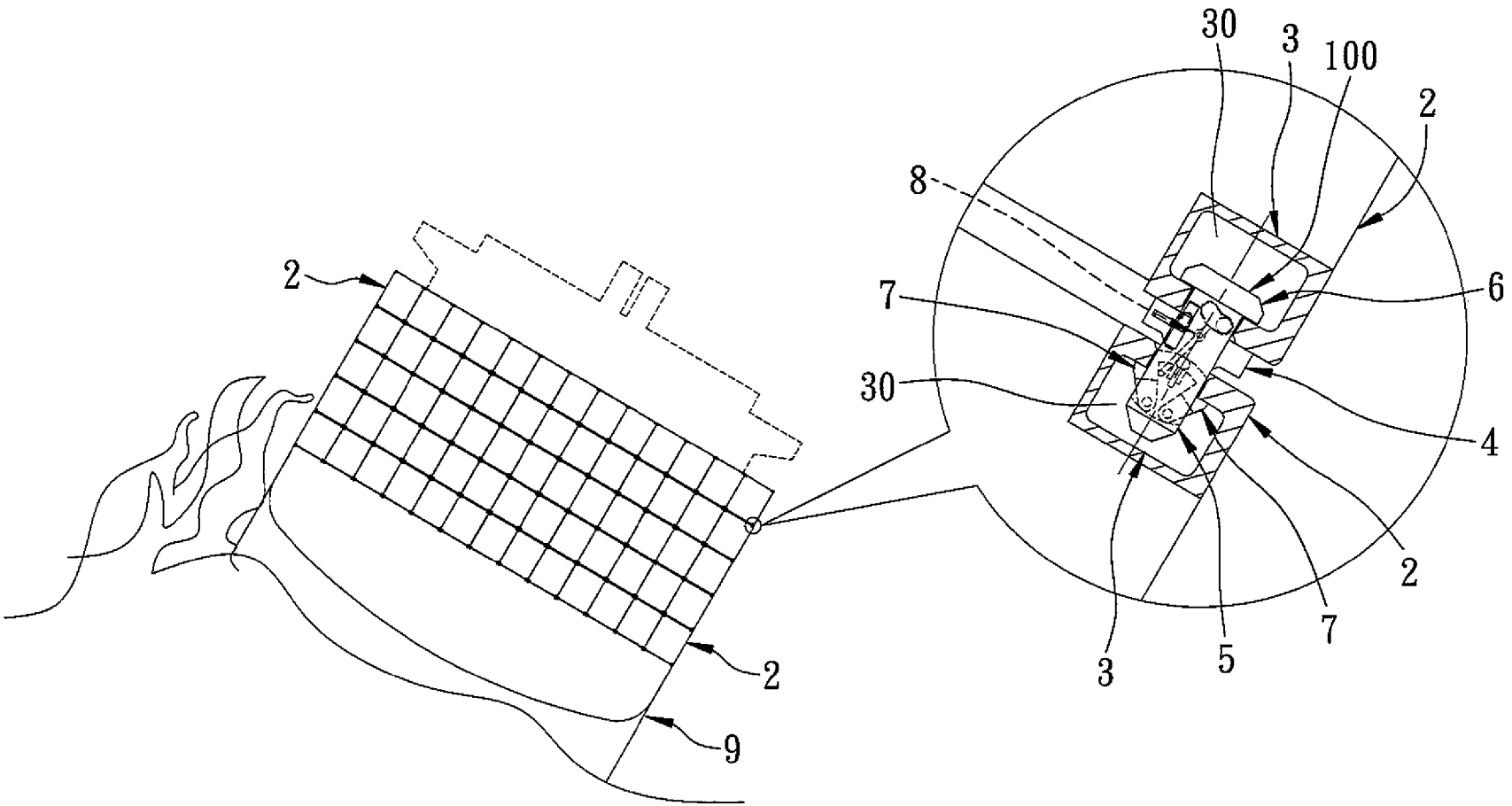
FIG. 8 illustrates how shipping containers are secured in a stack using the retainers of the present invention when a container ship encounters big waves.

Referring to FIG. 8, a plurality of shipping containers 2 are stacked on a container ship 9. The stacked containers 2 are coupled together by using a plurality of retainers 100 of the present invention. Each of the retainers 100 is adapted to secure together two corner pieces 3 of two superimposed upper and lower shipping containers 2. Each corner piece 3 has a hole 30.

Referring to FIGS. 3 to 7, each retainer 100 according to the preferred embodiment of the present invention defines an axial line (X), and is shown to comprise a lower retaining member 5, an upper retaining member 6, an intermediate member 4, a pair of swing members 7, and an actuating lever 8. The lower retaining member 5 is hollow, and is adapted to be inserted into the hole 30 in the corner piece 3 of the lower shipping container 2.

Figure 1:
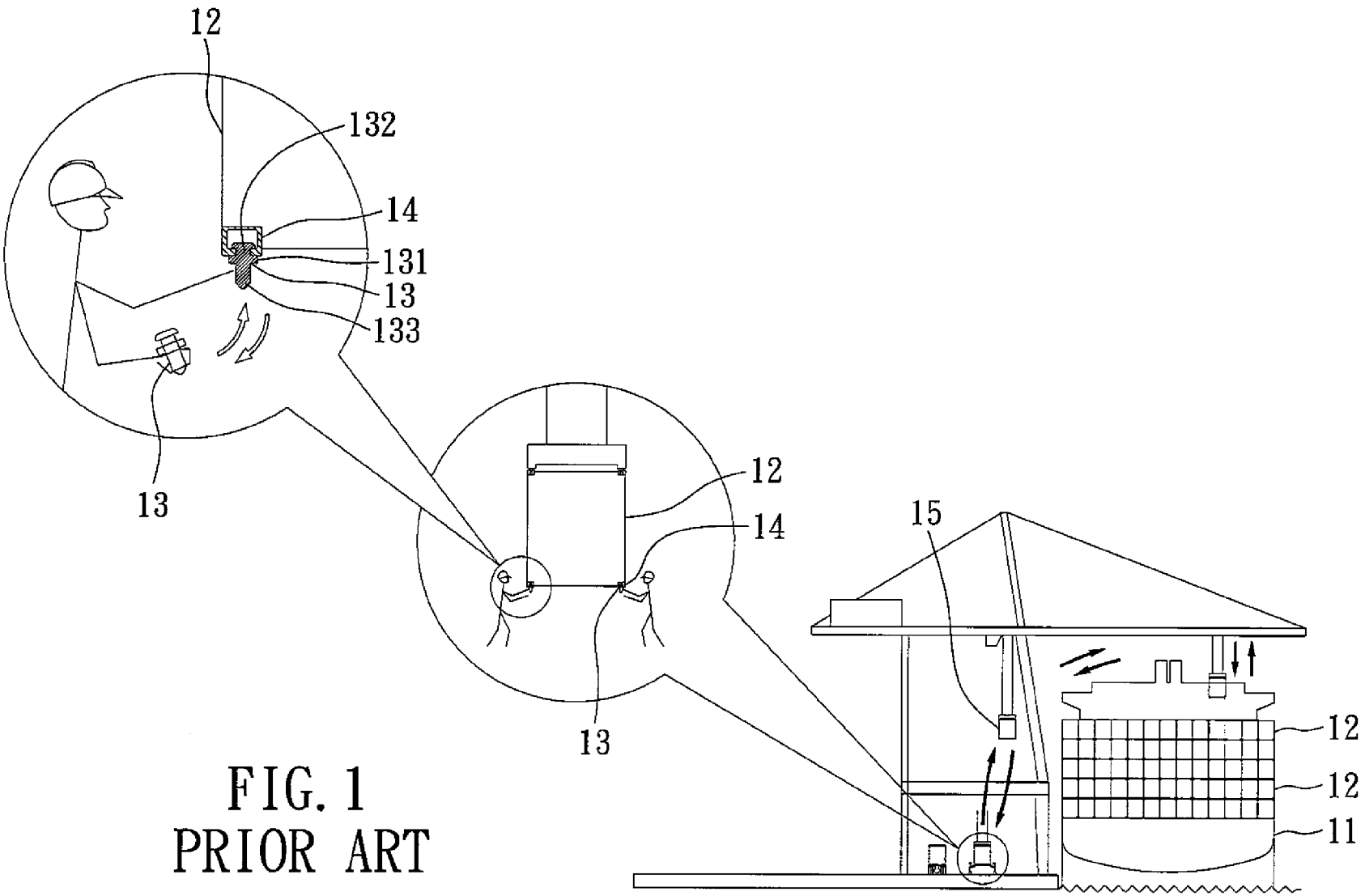
FIG. 1 PRIOR ART
FIG. 1 illustrates how shipping containers are stacked on a container ship.
Figure 2:
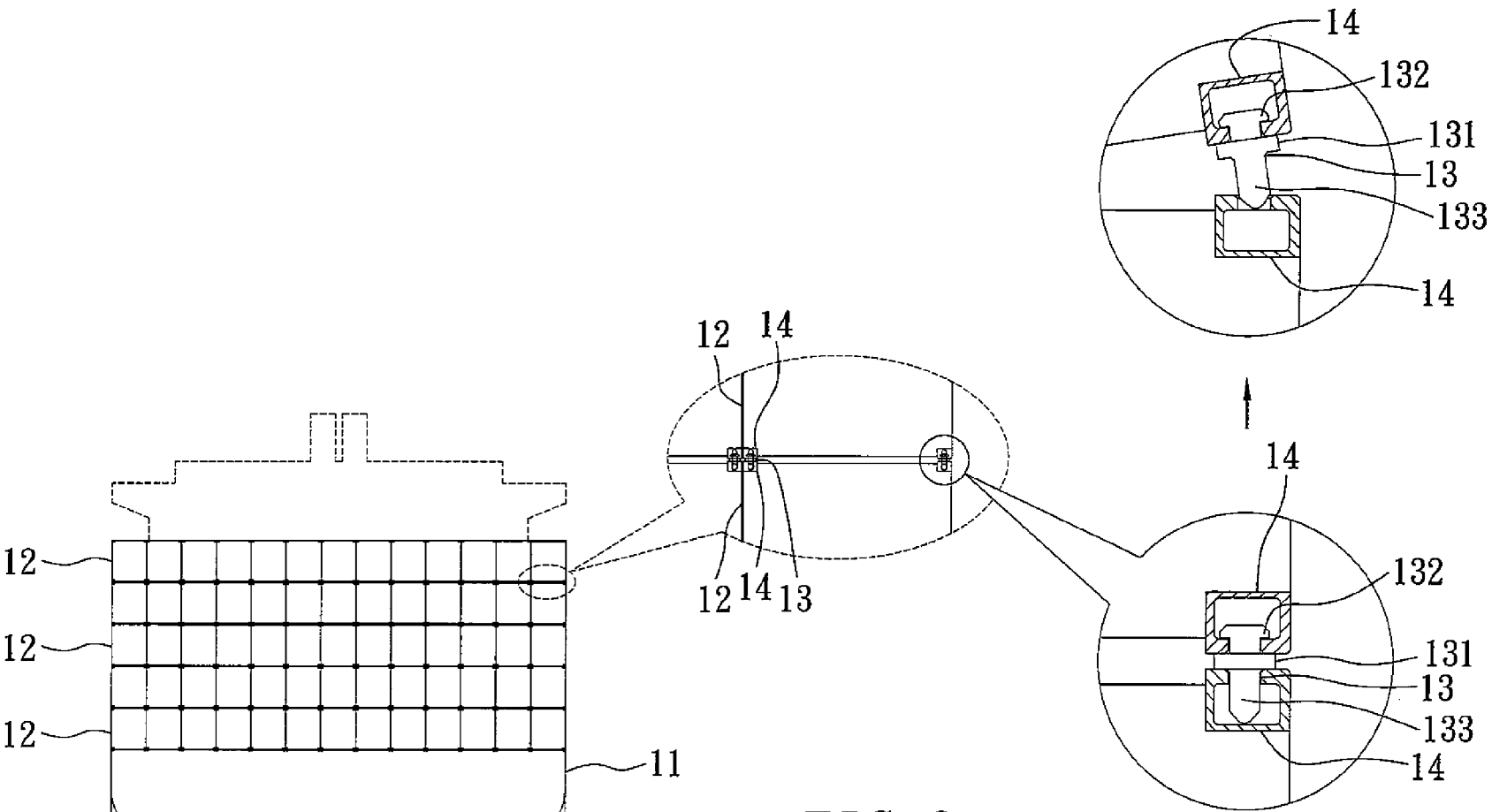
FIG. 2 PRIOR ART
FIG. 2 illustrates how the shipping containers of FIG. 1 are secured together using conventional retainers.
Figure 3:
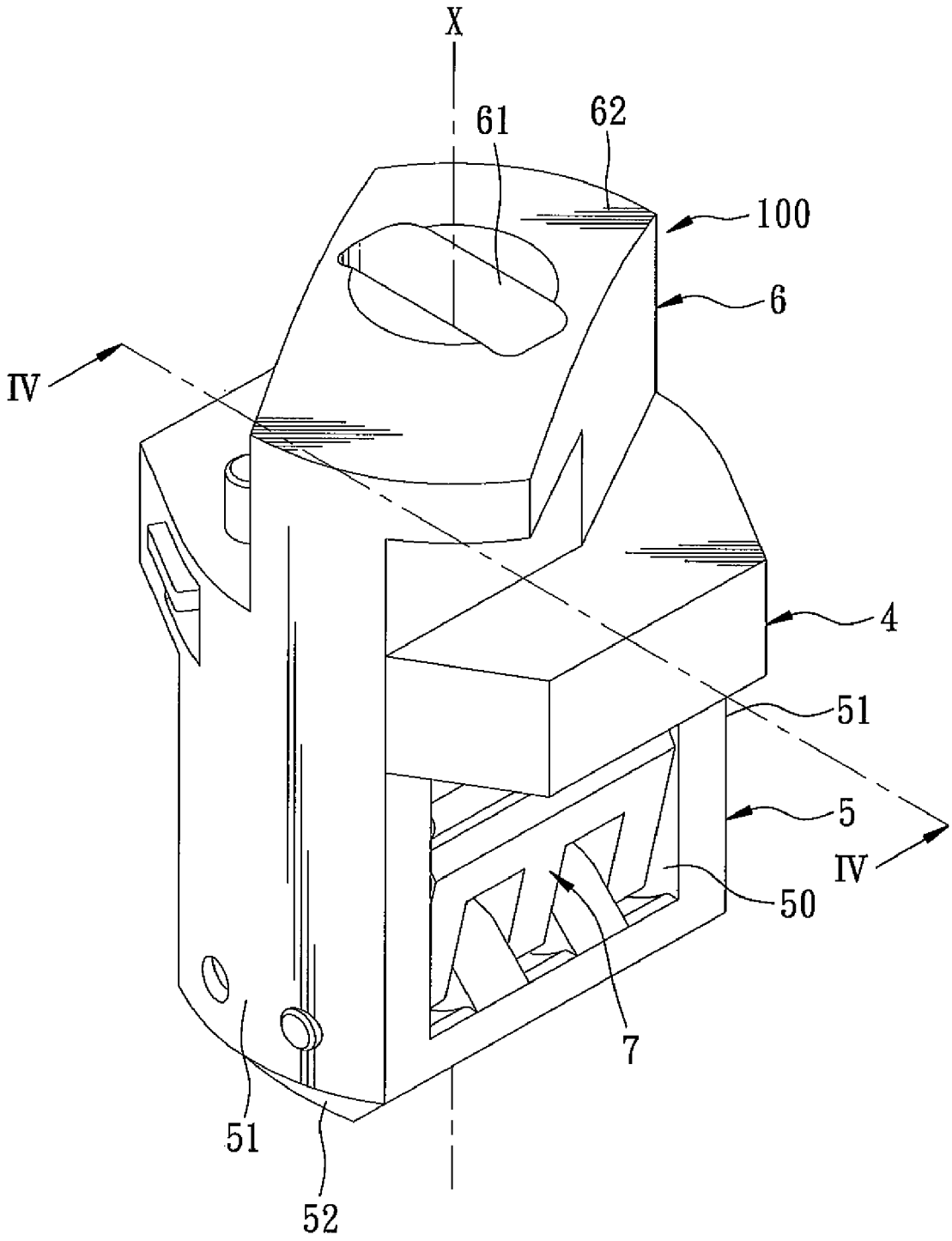
FIG. 3 is a perspective view of a retainer according to the preferred embodiment of the present invention.
Figure 4:
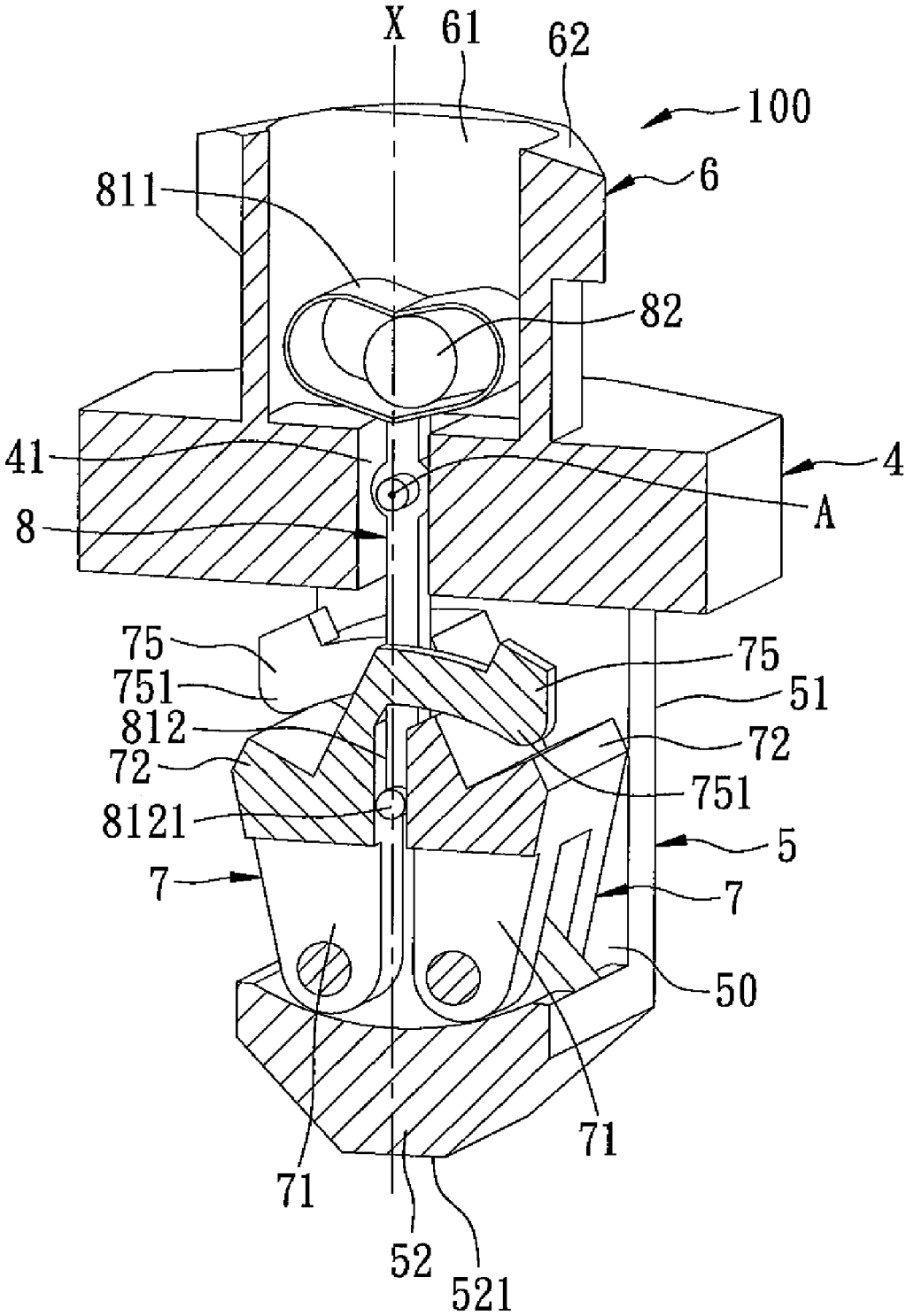
FIG. 4 is a sectional view of the preferred embodiment taken along line IV-IV of FIG. 3.
Figure 5:
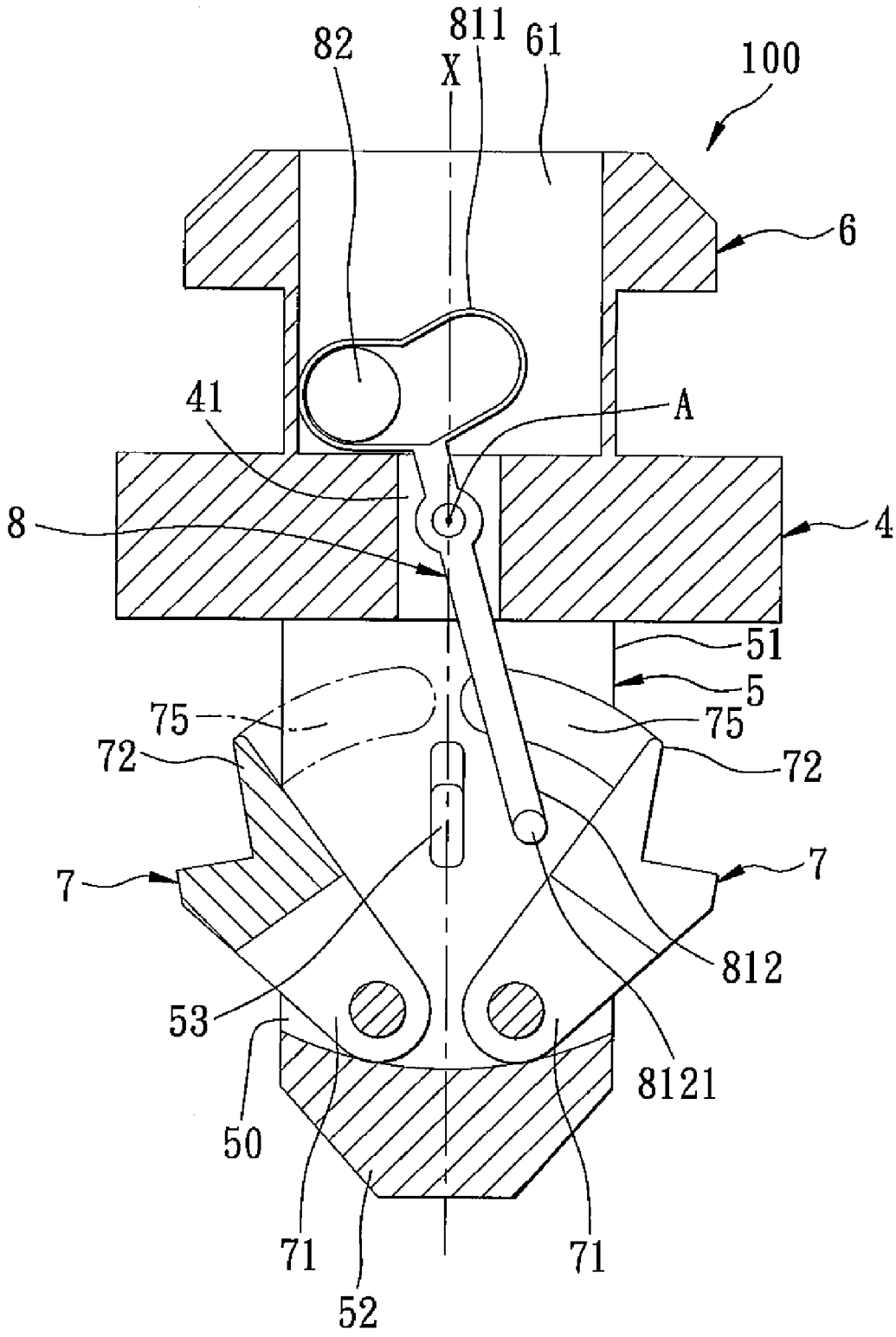
FIG. 5 is a view similar to FIG. 4, but illustrating how two swing members of the preferred embodiment are moved to an engaging position.

The lower retaining member 5 has two spaced-apart sidewalls 51, a bottom wall 52 interconnecting bottom ends of the sidewalls 51 and cooperating with the sidewalls 51 to define a receiving space 50, and two blocking members 53 (only one is shown in FIG. 5), each of which projects into the receiving space 50 from a respective one of the sidewalls 51 transversely of the axial line (X).

The upper retaining member 6 is connected to the lower retaining member 5, is adapted to be inserted into the hole 30 in the corner piece 3 of the upper shipping container 2, and has a top end 62 aligned with a bottom end 521 of the lower retaining member 5 along the axial line (X), and an axial hole 61 extending to the top end 62.

The intermediate member 4 is connected between the upper and lower retaining members 6, 5, is adapted to be disposed between the upper and lower shipping containers 2, and has a central hole 41 communicating with the axial hole 61 and the receiving space 50.

Figure 6:
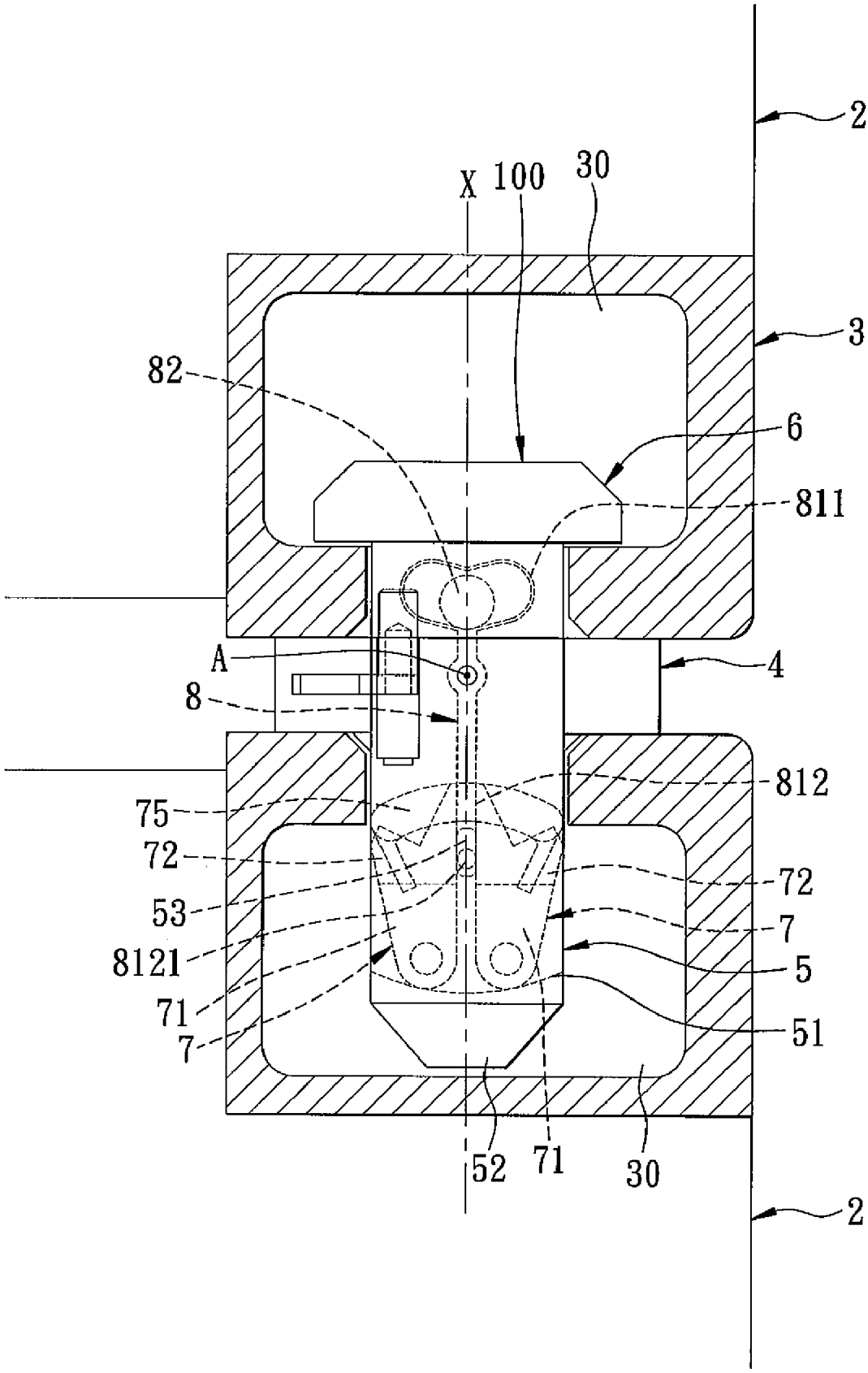
FIG. 6 is a schematic view of the preferred embodiment in a state of use.
Figure 7:
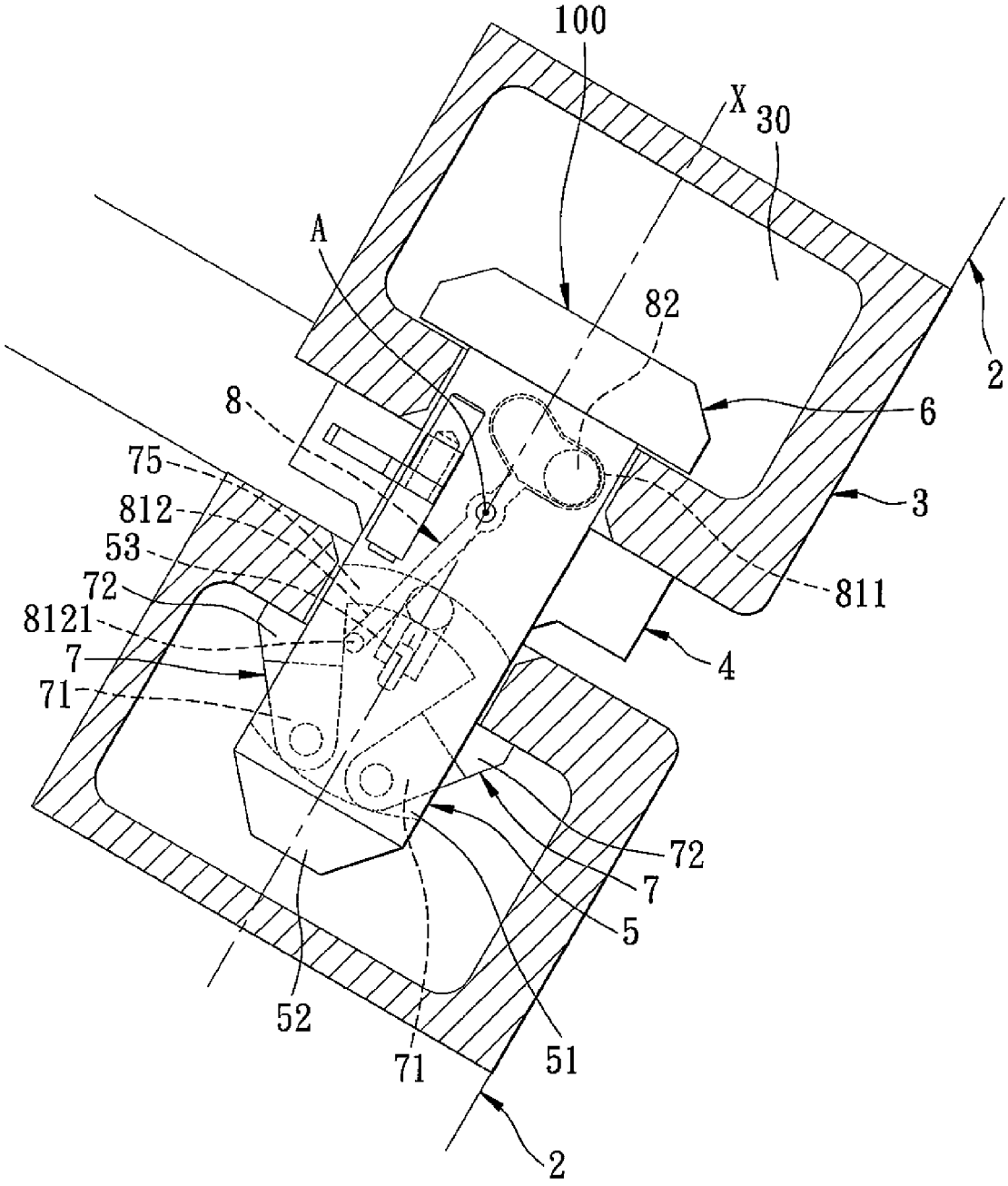
FIG. 7 is a view similar to FIG. 6, but illustrating how the retainer of the present invention secures together corner pieces of upper and lower shipping containers when an axial line of the retainer is inclined and non-vertical.

The swing members 7 are disposed inside the lower retaining member 5 within the receiving space 50 at two opposite sides of the axial line (X), respectively. Each swing member 7 includes a lower pivot portion 71 connected pivotally to and disposed between the sidewalls 51 and supported by the bottom wall 52, an upper engaging portion 72 extending upwardly from the lower pivot portion 71, and an arm 75 connected to the upper engaging portion 72 and extending transversely to the opposite side of the axial line (X). The upper engaging portion 72 is movable between a non-engaging position, as shown in FIGS. 9 and 6, and an engaging position, as shown in FIGS. 5 and 7. In the non-engaging position, the upper engaging portions 72 of the swing members 7 extend into the receiving space 50, so that the upper engaging portions 72 are proximate to the axial line (X), and do not engage the hole 30 in the corner piece 3 of the lower shipping container 2. In the engaging position, the upper engaging portions 72 of the swing members 7 extend outwardly of the receiving space 50, so that the upper engaging portions 72 are moved away from the axial line (X), and engage the hole 30 in the corner piece 3 of the lower shipping container 2.

The arm 75 of each swing member 7 has an arm counterweight 751 at the opposite other side of the axial line (X). Each blocking member 53 limits movement of the upper engaging portion 72 of each swing member 7 to the opposite side of the axial line (X), thereby placing the upper engaging portion 72 in the non-engaging position.

The actuating lever 8 is connected pivotally to the intermediate member 9 at a pivot point (A) located on the axial line (X), and has a head portion 811 extending upwardly from the pivot point (A) into the axial hole 61 and disposed movably in the upper retaining member 6, and a tail portion 812 extending downwardly from the pivot point (A) into the lower retaining member 5 between the swing members 7. The head portion 811 is hollow, and receives a counterweight ball 82 that is rollable therein. The tail portion 812 has a transverse rod 8121 disposed between the upper engaging portions 72 of the swing members 7. The actuating lever 8 is rotatable about the pivot point (A) so as to move the head portion 811 and the tail portion 812 in opposite directions, and is substantially aligned with the axial line (X) when the axial line (X) is substantially vertical.

Use of a single retainer 100 will be described hereinafter to simplify the description. With reference to FIGS. 6 and 8, the upper retaining member 6 is inserted into the hole 30 in the corner piece 3 of the upper shipping container 2, and may be rotated slightly so as to ensure secure positioning within the hole 30. The lower retaining member 5 is then inserted into the hole 30 in the corner piece 3 of the lower shipping container 2. Under normal circumstances, i.e., when the axial line (X) of the retainer 100 is substantially vertical, the upper engaging portions 72 of the swing members 7 are in the non-engaging positions, the counterweight ball 82 is located at the center of the head portion 811, and the tail portion 812 is located between the upper engaging portions 72 of the swing members 7. In this state, the lower retaining member 5 can be moved in or out of the hole 30 in the corner piece 3 of the lower shipping container 2 so as to proceed with a stacking or removing operation of the shipping containers 2.

With reference to FIGS. 7 and 8, when the container ship 9 encounters big waves that render the stack of the shipping containers 2 unstable, the axial line (X) of the retainer 100 is moved to incline, and is non-vertical. Consequently, the counterweight ball 82 of the retainer 100 rolls downward by gravity to one side of the head portion 811 away from the axial line (X), and the tail portion 812 of the actuating lever 81 moves upward to push the upper engaging portion 72 of one of the swing members 7 away from the axial line (X). The upper engaging portion 72 of the other swing member 7 moves away from the axial line (X) by gravity at the same time, so that the upper engaging portions 72 of the swing members 7 are in the engaging position that engage the hole 30 in the corner piece 3 of the lower shipping container 2. Hence, the lower retaining member 5 is prevented from moving out of the hole 30 in the corner piece 3 of the lower shipping container 2, thereby securing together the upper and lower shipping containers 2.

From the aforementioned description, it is apparent that when the axial line (X) of the retainer 100 of the present invention is inclined and non-vertical, the upper engaging portions 72 of the swing members 7 can automatically engage the hole 30 in the corner piece 3 of the lower shipping container 2, so that relative movement between the shipping containers 2 does not occur.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

What is claimed is:

1. A retainer for securing together upper and lower shipping containers, each of the upper and lower shipping containers being provided with a corner piece that has a hole, said retainer comprising:

a hollow lower retaining member adapted to be inserted into the hole in the corner piece of the lower shipping container and having a bottom end;

an upper retaining member connected to said lower retaining member and adapted to be inserted into the hole in the corner piece of the upper shipping container, said upper retaining member having a top end aligned with said bottom end along an axial line of said retainer; and at least one swing member disposed inside said lower retaining member at one side of said axial line, and including a lower pivot portion connected pivotally to said lower retaining member, and an upper engaging portion extending upwardly from said lower pivot portion, said upper engaging portion being in a non-engaging position when said axial line of said retainer is substantially vertical, and being in an engaging position when said axial line of said retainer is inclined and non-vertical, said upper engaging portion being proximate to said axial line when said upper engaging portion is in said non-engaging position, and moving away from said axial line when said upper engaging portion is in said engaging position.

2. The retainer of claim 1, wherein said swing member further includes an arm connected to said upper engaging portion and extending transversely to the opposite side of said axial line, said arm having an arm counterweight at the opposite side of said axial line.

3. The retainer of claim 2, wherein said lower retaining member further has a sidewall, and a blocking member projecting from said sidewall transversely of said axial line and said swing member to limit movement of said upper engaging portion to the opposite side of said axial line.

4. The retainer of claim 1, wherein a pair of said swing members are disposed inside said lower retaining member respectively at said one side and the opposite side of said axial line.

5. The retainer of claim 4, further comprising an intermediate member connected between said upper and lower retaining members and adapted to be disposed between the upper and lower shipping containers, and an actuating lever connected pivotally to said intermediate member at a pivot point located on said axial line and having a head portion extending upwardly from said pivot point into said upper retaining member, and a tail portion extending downwardly from said pivot point into said lower retaining member, said actuating lever being rotatable about said pivot point to move said head portion and said tail portion in opposite directions.

6. The retainer of claim 5, wherein said head portion is hollow, and receives a counterweight ball that is rollable therein.

7. The retainer of claim 6, wherein said actuating lever is substantially aligned with said axial line when said axial line is vertical, said counterweight ball rolling downward by gravity when said axial line is inclined so that said head portion moves downward and said tail portion moves upward to push said upper engaging portion of one of said swing members away from said axial line, said upper engaging portion of the other one of said swing members being moved away from said axial line by gravity.

8. The retainer of claim 4, wherein said lower retaining member has two spaced-apart sidewalls, and a bottom wall interconnecting bottom ends of said sidewalls and cooperating with said sidewalls to define a receiving space that receives said swing members, said lower pivot portions of said swing members being connected pivotally to and disposed between said sidewalls, said upper engaging portions of said swing members extending into said receiving space when in said non-engaging position and extending outwardly of said receiving space when in said engaging position.

* * * * *